US009577320B2

(12) United States Patent
Liou et al.

(10) Patent No.: US 9,577,320 B2
(45) Date of Patent: Feb. 21, 2017

(54) ANTENNA ASSEMBLY AND WIRELESS COMMUNICATION DEVICE EMPLOYING SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communications Systems, Inc., New Taipei (TW)

( * ) Notice: Subject to any disclaimer, the term of this patent is extended or adjusted under 35 U.S.C. 154(b) by 132 days.

(21) Appl. No.: 14/677,727

(22) Filed: Apr. 2, 2015

(65) Prior Publication Data

US 2016/0126620 A1 May 5, 2016

(30) Foreign Application Priority Data

Oct. 31, 2014 (CN) ..... 2014 1 0600735

(51) Int. Cl.
*H01Q 1/24* (2006.01)
*H01Q 1/22* (2006.01)

(52) U.S. Cl.
CPC ..... *H01Q 1/243* (2013.01); *H01Q 1/2291* (2013.01)

(58) Field of Classification Search
None
See application file for complete search history.

(56) References Cited

U.S. PATENT DOCUMENTS

2013/0300626 A1* 11/2013 Lee ..... H01Q 1/50 343/850
2014/0361948 A1* 12/2014 Tanaka ..... H01Q 1/38 343/861
2015/0009074 A1* 1/2015 Hsieh ..... H01Q 9/0421 343/700 MS

* cited by examiner

*Primary Examiner* — Robert Karacsony
(74) *Attorney, Agent, or Firm* — Zhigang Ma

(57) ABSTRACT

An antenna assembly includes an elastic piece, a connecting portion, a first radiating portion, and a second radiating. The connecting portion is coupled to the base board and includes a feeding point and a ground point. The first radiating portion is electrically connected to the feeding point and the elastic piece. The second radiating portion is electrically connected to the ground point and spaced from the first radiating portion. The first radiating portion, the elastic piece, and the second radiating portion are configured to operate at a first frequency band; the first radiating portion and the elastic piece generate a frequency-doubled effect to operate at a second frequency band. A wireless communication device employing the antenna assembly is also provided.

20 Claims, 4 Drawing Sheets

ANTENNA ASSEMBLY AND WIRELESS COMMUNICATION DEVICE EMPLOYING SAME

FIELD

The subject matter herein generally relates to an antenna assembly, and particularly relates to a coupled antenna assembly and a wireless communication device having the antenna assembly.

BACKGROUND

Most wireless communication devices may use a Bluetooth® antenna and a Wireless Fidelity (Wi-Fi) antenna for transmitting and receiving different wireless signals, respectively. This complicated structure makes in difficult to design smaller size to meet a miniaturization trend of the wireless communication devices.

BRIEF DESCRIPTION OF THE DRAWINGS

Implementations of the present technology will now be described, by way of example only, with reference to the attached figures.

DETAILED DESCRIPTION

Figure 1:
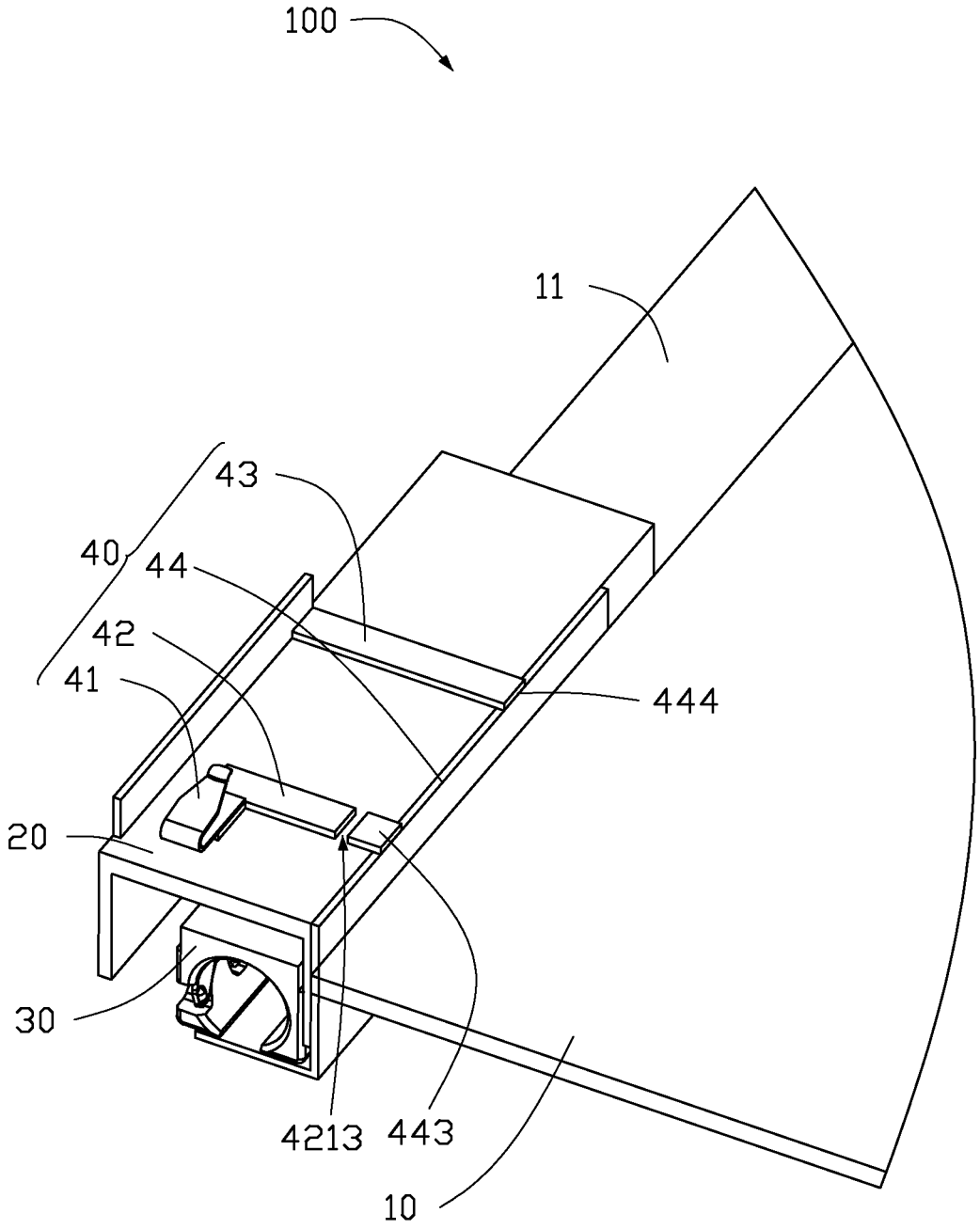
FIG. 1 is an isometric view of an embodiment of a wireless communication device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series and the like.

FIG. 1 illustrates at least one embodiment of a wireless communication device 100. The wireless communication device 100 can be a mobile phone, a tablet computer, or a PDA. The wireless communication device 100 includes a base board 10, a support member 20, a connector 30, and an antenna assembly 40. The support member 20 is coupled to a side of the base board 10. The antenna assembly 40 is coupled to the support member 20 and is configured to transmit and receive wireless signals in at least a Bluetooth® frequency band, from about 2,400 MHz to about 2,484 MHz, and a Wireless Fidelity (Wi-Fi) frequency band, from about 5,200 MHz to about 5,800 MHz. The connector 30 is received in the support member 20 and electrically connected to the base board 10 via the antenna assembly 40.

The base board 10 is substantially a rectangular printed circuit board (PCB) with a size of 131.6×66.8×10 $mm^3$ in at least one embodiment. A clearance zone 11 is defined above a portion of the base board 10 with a size of 66.8×7 $mm^2$ for decreasing external affection to the antenna assembly 40 and electronic components of the base board 10. In addition, the base board 10 can further includes a matching circuit (not shown) arranged in the clearance zone 11 and electrically connected to the antenna assembly 40 via cables for providing impedance matching for the antenna assembly 40. The matching circuit can be a traditional it type circuit or a traditional T type circuit.

Figure 2:
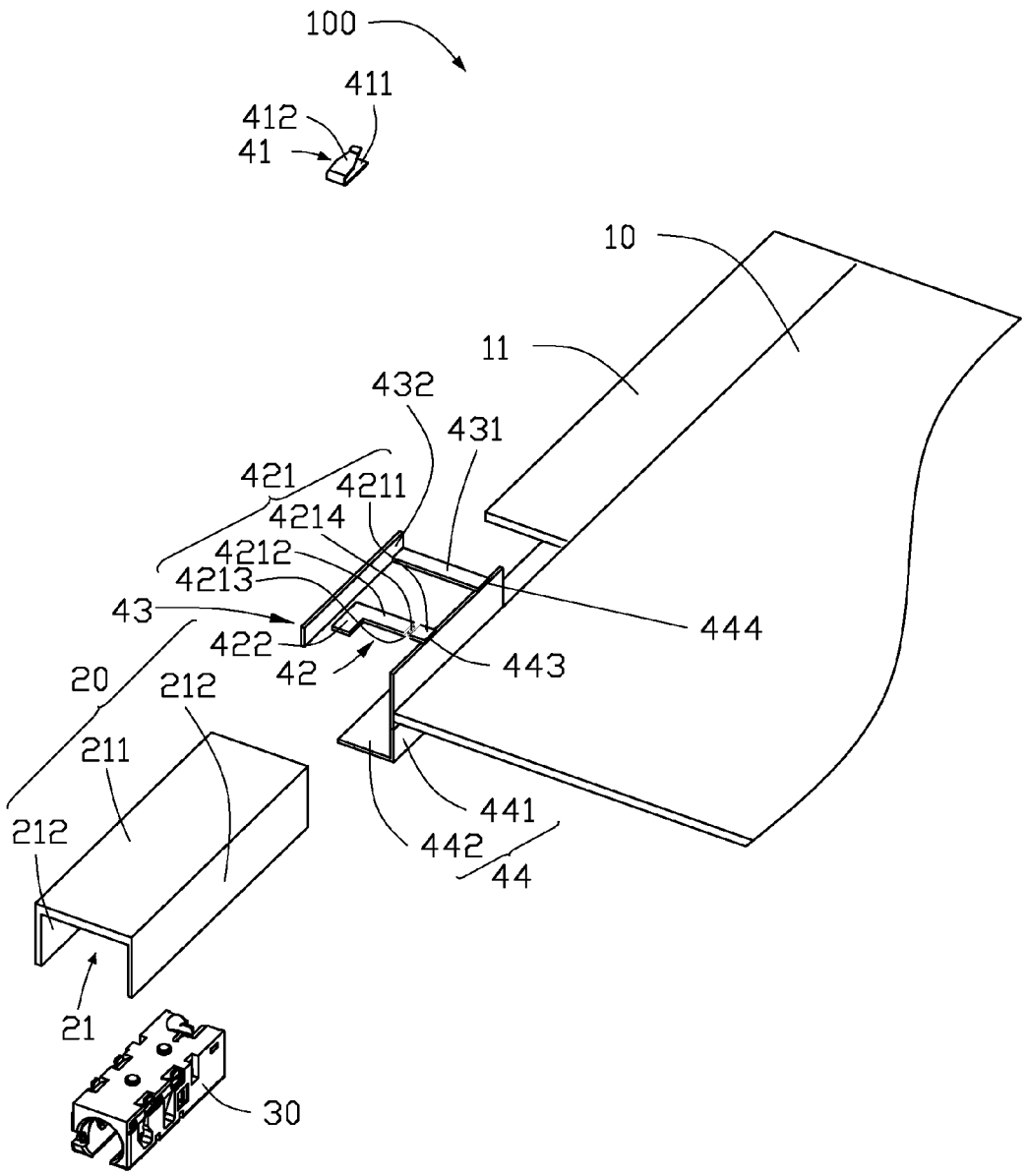
FIG. 2 is an explored view of the wireless communication device of FIG. 1.

FIGS. 1 and 2 illustrate that the support member 20 includes a top wall 211 and two opposite sidewalls 212 connected to opposite sides of the top wall 211. The top wall 211 and the two sidewalls 212 enclose a receiving space 21 for receiving the connector 30.

The antenna assembly includes an elastic piece 41, a first radiating portion 42, a second radiating portion 43, and a connecting portion 44. The first radiating portion 42, the second radiating portion 43, and the connecting portion 44 can be made by bending a flexible circuit board. The elastic piece 41 is substantially V-shaped and made of metal by bending. The elastic piece 41 includes a first bending portion 411 and a second bending portion 412 crookedly connected to the first bending portion 411. The first radiating section 421 and the second radiating section 422 are arranged on the top wall 211 and spaced from each other. The first radiating portion 42 is substantially L-shaped and includes a first radiating section 421 and a second radiating section 422. The first radiating section 421 is perpendicularly coupled to the second radiating section 422 and coplanar with the second radiating section 422. The first bending portion 411 is coupled to the second radiating section 422. The first radiating section 421 includes a first end 4211, a second end 4212, and a gap 4213 formed between the first end 4211 and the second end 4212. In at least one embodiment, a resistor 4214 of 50 ohm is received in the gap 4213 and electrically connected to the first end 4211 and the second end 4212.

The second radiating portion 43 includes a first extending section 431 and a second extending section 432 perpendicularly coupled to the first extending section 431. The first extending section 431 is paralleled to the first radiating section 421 and has a greater length than the first radiating section 421. The first extending section 431 is coplanar with the first radiating portion 42. A plane of the second extending section 432 is perpendicular to a plane of the first extending section 431. The first extending section 431 is coupled to the ground point 444. An end of the second extending section 432 is perpendicularly coupled to the first extending section 431, and the other end extends over the second radiating section 422. The second extending section 432 is perpendicular to the top wall 211 to increase an efficiency of the antenna assembly 40 at a frequency of about 2,400 MHz. In at least one embodiment, the first radiating section 421, the second radiating section 422, and the first extending section 431 can be pasted on the top wall 211.

The connecting portion 44 is substantially L-shaped and made of conductive material. The connecting portion 44 includes a first connecting section 441 and a second connecting section 442 perpendicularly coupled to the first connecting section 441. The first connecting section 441 is sandwiched between the sidewall 212 and a side of the base board 10. The first connecting section 441 includes a feeding point 443 and a ground point 444. The first end 4211 of the first radiating section 421 is electrically connected to the feeding portion 443. An end of the first extending section 431 is electrically connected to the ground point 444. The second connecting section 442 is parallel to the top wall 211 to partially cover the receiving space 21. The second connecting section 442 is configured to support the connector 30 and electrically connected to the connector 30, and further transmits signals between the connector 30 and the base board 10.

Figure 3:
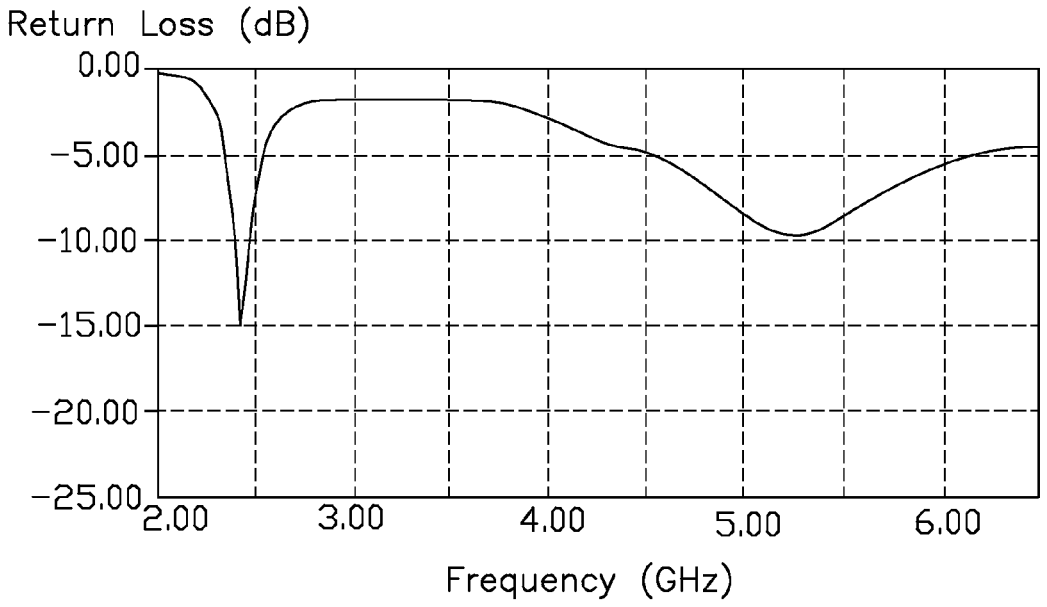
FIG. 3 is a return loss (RL) diagram of an antenna assembly of the wireless communication device of FIG. 1.
Figure 4:
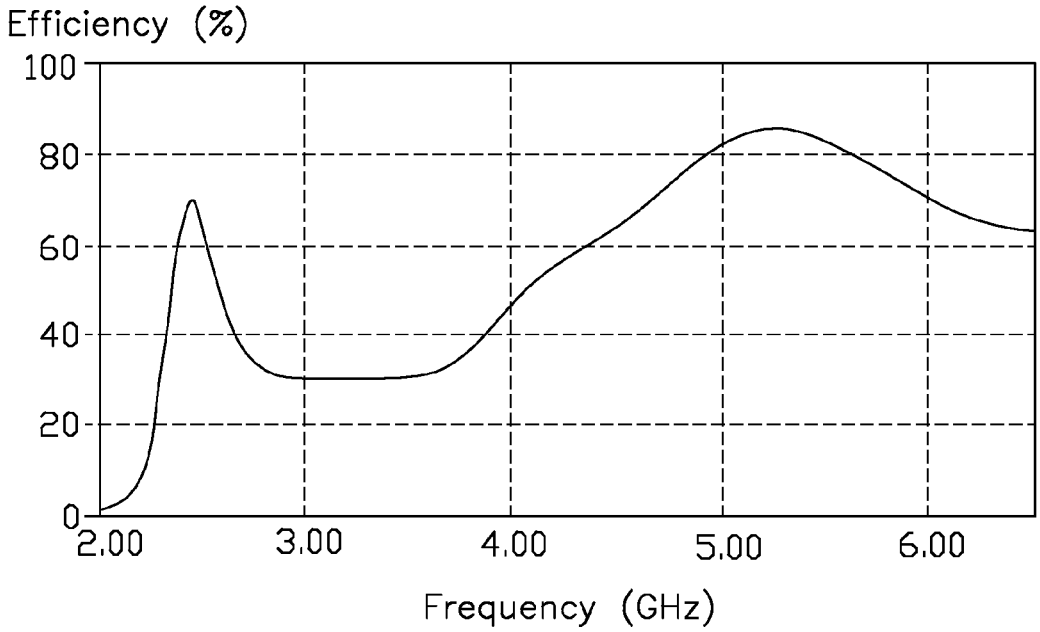
FIG. 4 is an antenna efficiency diagram of the antenna assembly of the wireless communication device of FIG. 1.

FIGS. 3 and 4 illustrate that when the wireless communication device 100 starts working, the first radiating section 421 feeds current from the feeding point 443, the current passes by the second radiating section and the elastic piece 41, and then is coupled to the second radiating portion 43, and then finally flows to the ground point 444, thereby forming a first current path. Thus, the antenna assembly 40 can work at a first frequency band from about 2,400 MHz to about 2,484 MHz. In at least one embodiment, the resistor 4214 received in the gag 4213 is configured to limit the current. In addition, the current on the first radiating portion 42 and the elastic piece 41 generate frequency-doubled effect. Thus, the antenna assembly 40 can work at a second frequency band from about 5,200 MHz to about 5,800 MHz.

A table 1 is presented as below, the table 1 illustrates that a preferable radiating efficiency of the antenna assembly 40, which can satisfy working requirements of the antenna assembly 40.

| Frequency (MHZ) | 2,400~2,484 | 5,200~5,800 |
|---|---|---|
| Efficiency (%) | 60~67 | 70~88 |

The antenna assembly 40 and the connector 30 is tightly arranged to each other via the support member 20, the decreased size allows employment in a miniaturized wireless communication device 100. In addition, the elastic piece 41 is coupled to the first radiating portion 42 and spaced away from the connector 30, which increases a height of the antenna assembly 40 and increases a frequency width for high frequency. A length of the elastic piece 41 increase a length of the current path, which may help to shift to low frequency of the wireless signals transmitted and received by the antenna assembly 40.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. An antenna assembly coupled to a base board, the antenna assembly comprising:

a base board;

a connecting portion coupled to the base board and comprising a feeding point and a ground point;

a first radiating portion electrically connected to the feeding point and an elastic piece; and a second radiating portion electrically connected to the ground point, and coupled to the first radiating portion via the elastic piece, and spaced from the first radiating portion;

wherein the first radiating portion, the elastic piece, and the second radiating portion are configured to operate at a first frequency band; the first radiating portion and the elastic piece generate a frequency-doubled effect to operate at a second frequency band.

2. The antenna assembly as claimed in claim 1, wherein the first radiating portion comprises a first radiating section and a second radiating section perpendicularly coupled to the first radiating section, the first radiating section is coplanar with the second radiating section.

3. The antenna assembly as claimed in claim 2, wherein the elastic piece is coupled to the second radiating section; the first radiating section comprises a first end, a second end, and a gap formed between the first end and the second end; the first end is electrically connected to the feeding end, the second end is coupled to the second radiating section.

4. The antenna assembly as claimed in claim 3, wherein the gap receive a resistor for electrically connected to the first end and the second end, the resistor is configured to limit current for the first radiating portion.

5. The antenna assembly as claimed in claim 3, wherein the elastic piece is substantially V-shaped and made of metal by bending, the elastic piece comprises a first bending portion and a second bending portion crookedly connected to the first bending portion, the first bending portion is coupled to the second radiating section.

6. The antenna assembly as claimed in claim 3, wherein the second radiating portion comprises a first extending section and a second extending section perpendicularly coupled to the first extending section; the first extending section is coupled to the ground point, an end of the second extending section is perpendicularly coupled to the first extending section, and the other end extends over the second radiating section.

7. The antenna assembly as claimed in claim 6, wherein the first extending section is paralleled to the first radiating section and has a greater length than the first radiating section, the first extending section is coplanar with the first radiating portion, a plane of the second extending section is perpendicular to a plane of the first extending section.

8. The antenna assembly as claimed in claim 7, wherein the connecting portion is made of conductive material and comprises a first connecting section and a second connecting section perpendicularly coupled to the first connecting section; the first connecting section is coupled to the base board, the feeding point and the ground point are arranged on the first connecting section.

9. A wireless communication device comprising:

a base board;

a support member;

a connector received in the support member; and an antenna assembly coupled to the base board and arranged on the support member, the antenna assembly comprising:

an elastic piece;

a connecting portion coupled to the base board and comprising a feeding point and a ground point;

a first radiating portion electrically connected to the feeding point and the elastic piece;

a second radiating portion electrically connected to the ground point, and coupled to the first radiating portion via the elastic piece, and spaced from the first radiating portion; and a connecting portion configured to support the connector and electrically connected to the connector;

wherein the first radiating portion, the elastic piece, and the second radiating portion are configured to operate at a first frequency band; the first radiating portion and the elastic piece generate a frequency-doubled effect to operate at a second frequency band.

10. The wireless communication device as claimed in claim 9, wherein the support member comprises a top wall and two opposite sidewall, the top wall and the two opposite sidewall enclose a receiving space configured to receive the connector.

11. The wireless communication device as claimed in claim 10, wherein the first radiating portion and the second radiating portion are arranged on the top wall, the first radiating portion comprises a first radiating section and a second radiating section perpendicularly coupled to the first radiating section, the first radiating section is coplanar with the second radiating section.

12. The wireless communication device as claimed in claim 11, wherein the elastic piece is coupled to the second radiating section; the first radiating section comprises a first end, a second end, and a gap formed between the first end and the second end; the first end is electrically connected to the feeding end, the second end is coupled to the second radiating section.

13. The wireless communication device as claimed in claim 12, wherein the gap receive a resistor for electrically connected to the first end and the second end, the resistor is configured to limit current for the first radiating portion.

14. The wireless communication device as claimed in claim 12, wherein the elastic piece is substantially V-shaped and made of metal by bending, the elastic piece comprises a first bending portion and a second bending portion crookedly connected to the first bending portion, the first bending portion is coupled to the second radiating section.

15. The wireless communication device as claimed in claim 12, wherein the second radiating portion comprises a first extending section and a second extending section perpendicularly coupled to the first extending section; the first extending section is coupled to the ground point, an end of the second extending section is perpendicularly coupled to the first extending section, and the other end extends over the second radiating section, the second extending section is perpendicular to the top wall to increase an efficiency of the antenna assembly.

16. The wireless communication device as claimed in claim 15, wherein the first extending section is paralleled to the first radiating section and has a greater length than the first radiating section, the first extending section is coplanar with the first radiating portion, a plane of the second extending section is perpendicular to a plane of the first extending section.

17. The wireless communication device as claimed in claim 16, wherein the connecting portion is made of conductive material and comprises a first connecting section and a second connecting section perpendicularly coupled to the first connecting section; the first connecting section is sandwiched between the base board and one of the sidewall of the support member, the feeding point and the ground point are arranged on the first connecting section.

18. The wireless communication device as claimed in claim 17, wherein the connector is supported on the second connecting section and electrically connected to the base board via the connecting portion.

19. The wireless communication device as claimed in claim 9, wherein the base board is a printed circuit board defining a clearance zone for providing impedance matching for the antenna assembly.

20. The wireless communication device as claimed in claim 9, wherein the first radiating portion, the second radiating portion, and the connector are electrically connected the base via the connecting portion, the connecting portion is configured to transmit signals between the first radiating portion, the second radiating portion, the connector and the base board.

* * * * *